US009964374B1

(12) United States Patent
Facchini et al.

(10) Patent No.: US 9,964,374 B1
(45) Date of Patent: May 8, 2018

(54) MODULAR FIREARM SYSTEM

(71) Applicant: FIMS Manufacturing Corp., Oakland, NJ (US)

(72) Inventors: Michael Facchini, Oakland, NJ (US); Matthew Steinhauser, Oakland, NJ (US)

( * ) Notice: Subject to any disclaimer, the term of this patent is extended or adjusted under 35 U.S.C. 154(b) by 0 days. days.

(21) Appl. No.: 15/800,979

(22) Filed: Nov. 1, 2017

Related U.S. Application Data

(60) Provisional application No. 62/526,624, filed on Jun. 29, 2017.

(51) Int. Cl.

| | |
|---|---|
| ***F41A 21/00*** | (2006.01) |
| ***F41A 11/02*** | (2006.01) |
| *F41A 21/48* | (2006.01) |
| *F41A 3/66* | (2006.01) |

(52) U.S. Cl.
CPC ..... *F41A 11/02* (2013.01); *F41A 3/66* (2013.01); *F41A 21/482* (2013.01)

(58) Field of Classification Search
USPC ..... 42/75.02, 75.1, 75.01
See application file for complete search history.

(56) References Cited

U.S. PATENT DOCUMENTS

| | | | | |
|---|---|---|---|---|
| 7,587,853 | B2 | 9/2009 | Aalto | |
| 7,905,041 | B1 * | 3/2011 | Davies | F41A 3/66 42/75.02 |
| 7,975,417 | B2 | 7/2011 | Duplessis | |
| 8,490,312 | B2 | 7/2013 | Barrett | |
| 8,505,227 | B2 * | 8/2013 | Barrett | F41A 3/26 42/75.02 |
| 8,539,708 | B2 * | 9/2013 | Kenney | F41A 21/485 42/75.01 |
| 8,689,478 | B2 | 4/2014 | Patel | |
| 8,910,408 | B2 | 12/2014 | Masters | |

OTHER PUBLICATIONS

LEO Takedown, Mar. 22, 2017, www.leotakedown.com.
LEO Takedown, Apr. 30, 2017, LEO Takedown: Swap Your AR Barrel in Seconds!—NRA 2017, www.youtube.com/watch?v=Lsb1ODZEn64.
LEO Takedown, Jan. 24, 2017, LEO TakeDown interchangeable AR-15 barrel system, www.youtube.com/watch?v=Zjdrb6YguUQ.
LEO Takedown, Apr. 28, 2017, LEO TakeDown—Promo, www.youtube.com/watch?v=9rpKkAuWnSM.

* cited by examiner

*Primary Examiner* — John W Eldred
(74) *Attorney, Agent, or Firm* — John H. Choi & Associates LLC

(57) ABSTRACT

A modular firearm system capable of easily attaching and detaching an upper receiver and a barrel is disclosed. The upper receiver is operably coupled to a bearing case. A biasing member is positioned on the bearing case. A plurality of bearings are positioned on the bearing case. A spring sleeve is engageable with the biasing member and circumscribes the bearing case, biasing member and bearings. A face plate is positioned adjacent to the bearing case and fixedly coupled thereto. The face plate engages the spring sleeve such that the biasing member and bearings are enclosed within the spring sleeve and the face plate. A barrel sleeve is operably coupled to the barrel. In an engaged state, the barrel sleeve is positioned within the bearing case and the bearings are positioned between the barrel sleeve and bearing case such that the upper receiver and barrel are substantially aligned.

20 Claims, 22 Drawing Sheets

MODULAR FIREARM SYSTEM

CROSS-REFERENCE TO RELATED APPLICATION

This application claims priority to U.S. Provisional Application No. 62/526,624, filed on Jun. 29, 2017, which is incorporated by reference in its entirety.

FIELD

The present disclosure relates to firearm accessories and in particular to a barrel coupling mechanism to form a modular firearm system.

BACKGROUND

Over the years, it has become essential that firearms, like many other devices, be capable of convenient and discrete transport. Although handguns are fairly easy to store and transport in compact carrying cases, it is not as easy to do so with rifles with longer barrels.

Therefore, some rifles have been manufactured with barrels that can be disassembled, i.e., modular rifles, so that smaller carrying cases could be utilized to transport the same. A modular rifle typically includes a lower receiver assembly, an upper receiver assembly, a barrel and a coupling mechanism for coupling the barrel to the upper receiver assembly. The M-16 style rifle is a type of modular rifle system commonly used by military and law enforcement that features a gas-operated bolt and bolt carrier system, as disclosed, for example, in U.S. Pat. No. 2,951,424, issued to Eugene M. Stoner on Sep. 6, 1960 (incorporated herein by reference in its entirety). The AR-15 style rifle is a similarly designed modular rifle system commonly sold and used in civilian applications.

For most M-16/AR-15 style rifle systems, the barrel is assembled by connecting the barrel to the upper receiver utilizing a barrel nut through threaded engagement. The barrel nut must be appropriately torqued to properly align the barrel and completely tighten the barrel nut, typically requiring the use of specialized tools and a bench vise. Consequently, the barrel cannot be quickly or easily removed, changed, or assembled in the field under combat conditions or exigent circumstances, and the rifle system cannot be quickly and easily stored in a disassembled state.

In response to the problems associated with the traditional threaded engagement of the barrel and upper receiver, various devices and mechanisms that do not require tools for assembly and disassembly have been introduced in the market. A popular alternative is a tool-free retrofitted coupling mechanism meant to reduce time to assemble and disassemble the rifle. However, even though they are tool-free, the coupling mechanisms in the prior art pose several disadvantages.

First, it is difficult to accomplish a secure fit when assembled. Not only is a secure fit critical to the rifle's proper function but a non-secure fit is a major safety hazard.

Second, the inside of the barrel could be exposed to dust and debris because the coupling mechanisms of the prior art are not completely sealed when in use. Again, this could be detrimental to the proper function of the rifle as well as to the safety of the user.

Third, the coupling mechanisms of the prior art often times require additional fabrication on the existing barrel and upper receiver, for example, fabrication or modification of existing threads. Hence, the user may not be able to install the coupling mechanism himself and additional costs for installation might be required.

Therefore, a need exists for a coupling mechanism that can be easily installed, and for quickly and easily attaching and detaching a barrel of a firearm while providing a secure attachment during use.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The barrel coupling mechanism of the present invention solves the problems of the prior art and provides additional advantages. The barrel coupling mechanism of the present invention provides for a barrel of a firearm to be securely assembled and quickly disassembled without any tools.

In general, the barrel coupling mechanism of the present invention includes a ball bearing case fixedly coupled with an upper receiver of a firearm. The ball bearing case is configured such that a biasing member is positioned and secured at a lower end thereof. The ball bearing case includes a plurality of slots for each housing a ball bearing. The ball bearings and biasing member are further secured within the ball bearing case by a spring sleeve, which circumscribes the ball bearing case and is engaged with the biasing member. The spring sleeve is self-secured onto the ball bearing case by virtue of limited clearance between the spring sleeve inner end and the upper receiver, and limited clearance between the spring sleeve outer end and the ball bearings. A barrel sleeve is fixedly coupled on one end to an end of a barrel. On an opposite end, the barrel sleeve includes a plurality of grooves for engagement with the ball bearings located on the ball bearing case.

In operation, the barrel sleeve is inserted into spring sleeve and ball bearing case while the spring sleeve is retracted, thereby releasing the ball bearings radially outward. The spring sleeve is released and the ball bearings engage the barrel sleeve grooves, thereby forming a secure coupling between the barrel and upper receiver of the firearm. To disassemble, the spring sleeve is retracted such that the ball bearings disengage from the barrel sleeve grooves. The barrel sleeve is then removed from the spring sleeve and ball bearing case.

In one aspect, the present invention provides a modular rifle system comprising: an upper receiver, the upper receiver having a free end, the free end having first threads circumscribing an outer section thereof, the free end having a void positioned at an outermost portion thereof; a bearing case comprising an upper member and a lower member, the upper member having an outer diameter less than an outer diameter of the lower member such that an upper surface is formed therebetween, the upper member having a plurality of slots formed therein, the lower member having second threads circumscribing an inner section thereof, the bearing case operably coupled to the upper receiver free end by engagement of the first and second threads; a biasing member positioned on the upper surface of the bearing case; a plurality of bearings, each bearing positioned within each slot; a spring sleeve circumscribing the bearing case, biasing member and bearings, the spring sleeve being engaged with the biasing member; a face plate positioned adjacent to the bearing case and fixedly coupled thereto, the face plate engaging the spring sleeve such that the biasing member and bearings are enclosed within the spring sleeve and face plate; a barrel having a first end and an opposing second end and a ring therebetween, a pin extending from the barrel between the ring and the second end; a barrel sleeve comprising an inner section and an outer section, the inner section having third threads circumscribing an outer portion thereof, the outer section having a plurality of grooves positioned on an outer portion thereof, the barrel sleeve circumscribing the barrel and positioned adjacent the ring between the barrel first end and the ring such that the barrel sleeve outer section engages the ring; and a barrel nut having fourth threads circumscribing an inner section thereof and fifth threads circumscribing an outer section thereof, the barrel nut circumscribing the barrel and positioned between the first end and the barrel sleeve, the barrel nut operably coupled with the barrel sleeve by engaging the third and fourth threads; wherein in an engaged state, the barrel sleeve is positioned within the bearing case such that each bearing is positioned within a corresponding groove and the pin is positioned within the void such that the upper receiver and barrel are substantially aligned.

In another aspect, the present invention provides a modular rifle system comprising: an upper receiver, the upper receiver having a free end, the free end having first threads circumscribing an outer section thereof, the free end having a void positioned at an outermost end; a bearing case comprising an upper member and a lower member, the upper member having an outer diameter less than an outer diameter of the lower member such that an upper surface is formed therebetween, the upper member having a plurality of slots formed therein, each slot extending through the upper member to form a slot aperture, the lower member having second threads circumscribing an inner section thereof, the bearing case operably coupled to the upper receiver free end by engagement of the first and second threads; a biasing member positioned on the upper surface of the bearing case; a plurality of bearings, each bearing positioned within each slot and partially extendable through the slot aperture; a spring sleeve circumscribing the bearing case, biasing member and bearings, the spring sleeve being engaged with the biasing member; a face plate positioned adjacent to the bearing case and fixedly coupled thereto, the face plate engaging the spring sleeve such that the biasing member and bearings are enclosed within the spring sleeve and the face plate; a barrel having a first end and an opposing second end and a ring therebetween, a pin extending from the barrel between the ring and the second end; and a barrel sleeve comprising an inner section and an outer section, the barrel sleeve operably coupled to the barrel proximate the barrel second end, the outer section having a plurality of grooves positioned on an outer portion thereof; wherein in an engaged state, the barrel sleeve is positioned within the bearing case such that each bearing is positioned within a corresponding groove and the pin is positioned within the void such that the upper receiver and barrel are substantially aligned.

In yet another aspect, the present invention provides a modular rifle system comprising: an upper receiver having a free end, a bearing case operably coupled to the upper receiver free end; a biasing member positioned on the bearing case; a plurality of bearings, each bearing positioned on the bearing case; a spring sleeve engageable with the biasing member and circumscribing the bearing case, biasing member and bearings; a face plate positioned adjacent to the bearing case and fixedly coupled thereto, the face plate engaging the spring sleeve such that the biasing member and bearings are enclosed within the spring sleeve and the face plate; a barrel having a first end and a second end; and a barrel sleeve operably coupled to the barrel; wherein in an engaged state, the barrel sleeve is positioned within the bearing case and the bearings are positioned between the barrel sleeve and bearing case such that the upper receiver and barrel are substantially aligned.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In addition, some of the figures are provided further details including exemplary dimensions which are in units of inches.

In the drawings.

Figure 1:
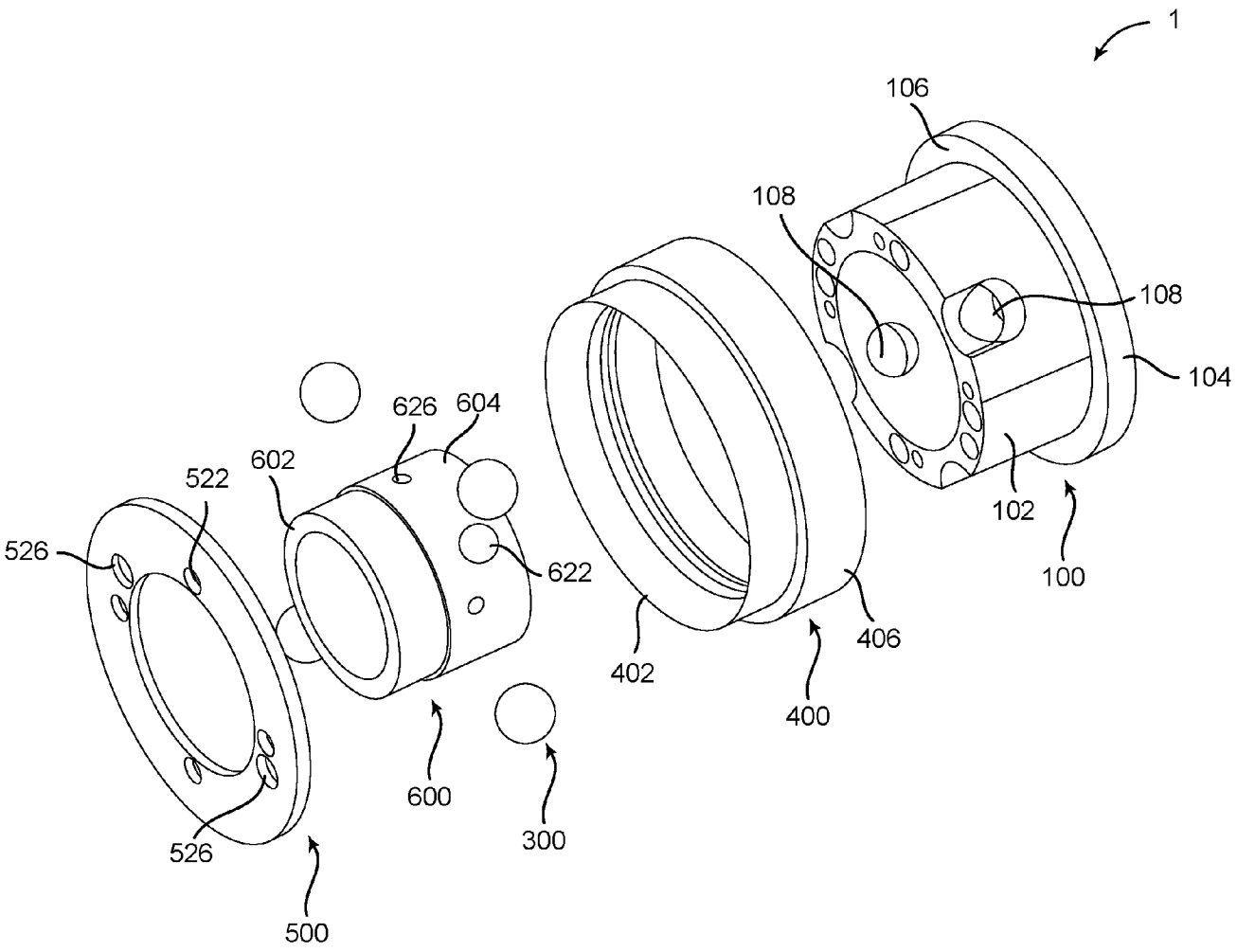
FIG. 1 is an exploded view of an embodiment of a barrel coupling mechanism or device of the present invention.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Figure 11:
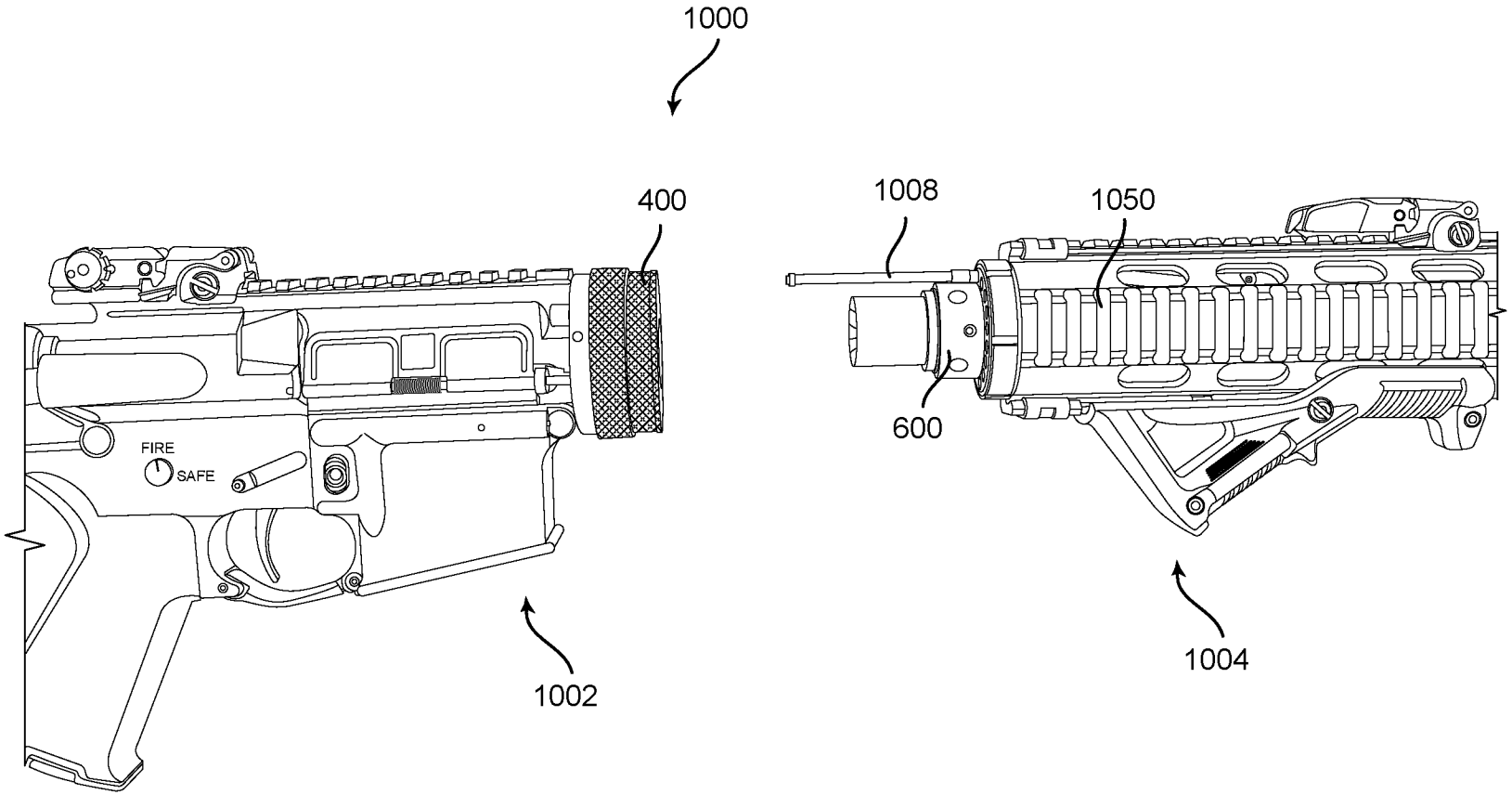
FIG. 11 is a plan view of a firearm with the device of the present invention installed but in an uncoupled state.
Figure 12:
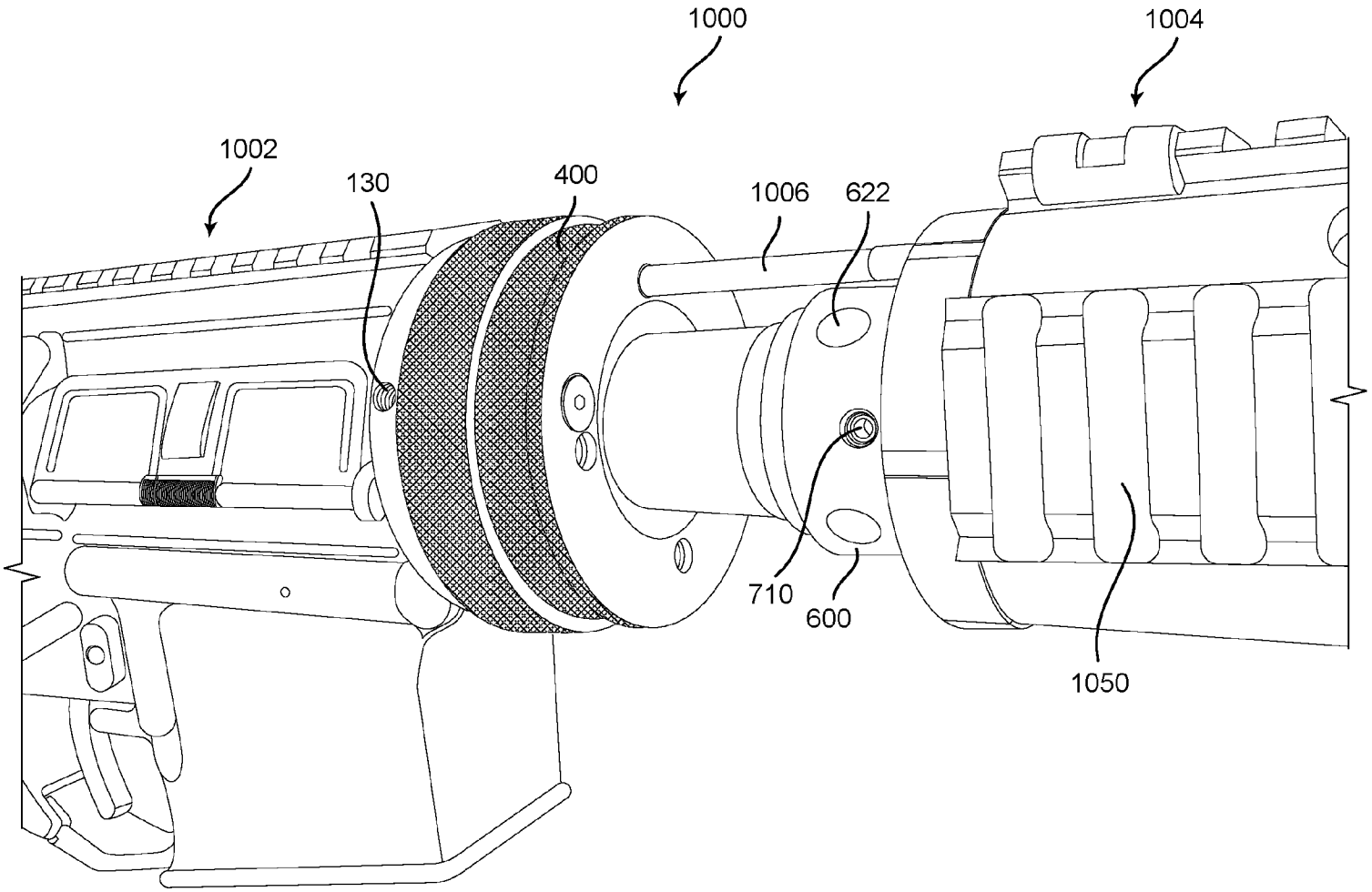
FIG. 12 is a perspective view of a firearm with the device of the present invention installed but in a partially coupled state.
Figure 13:
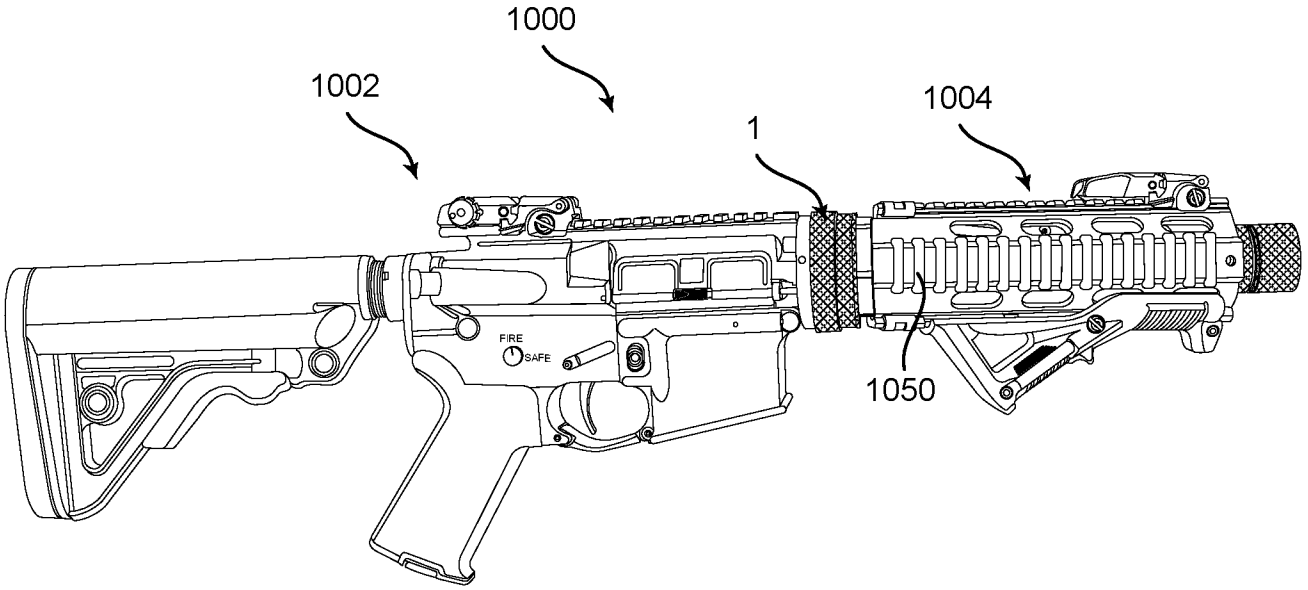
FIG. 13 is a plan view of a firearm with the device of the present invention in an installed and fully coupled or engaged state.
Figure 14:
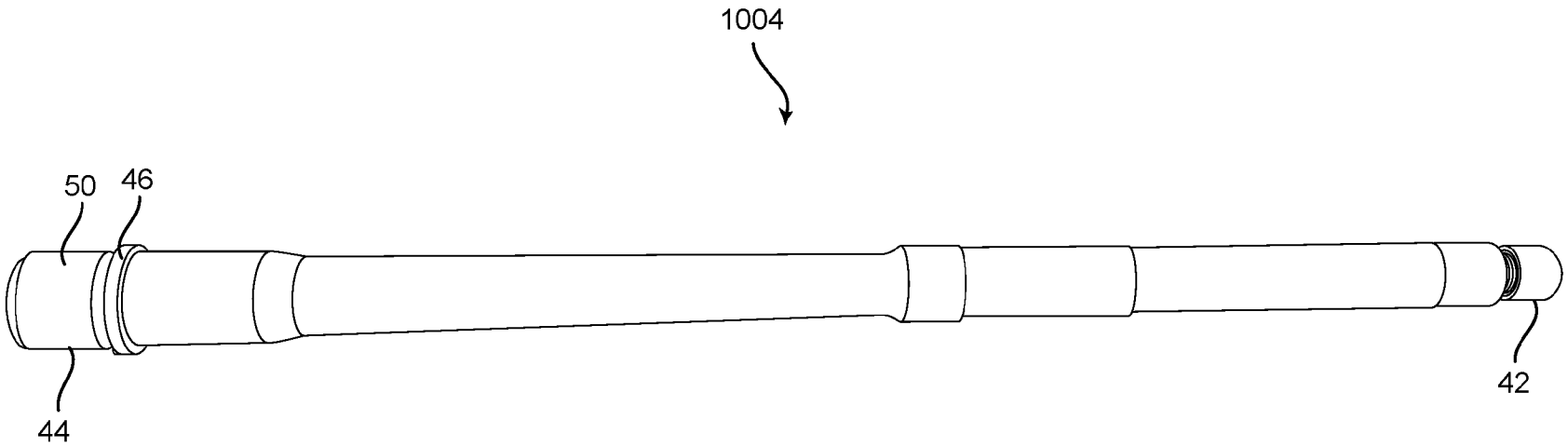
FIG. 14 is a plan view of a barrel of a firearm.

Referring to FIGS. 11-13, in general, the barrel coupling mechanism 1 of the present invention provides the user the ability to quickly attach and detach a barrel or barrel portion 1004 from and to an upper receiver 1002 of a firearm 1000.

Referring to FIGS. 14-18, the barrel 1004 includes a first end 42 where a bullet exits the firearm 1000, and a second end 44 where the barrel 1004 is coupled to the upper receiver 1002. The second end 44 includes a ring 46 integrally formed with the barrel 1004, which circumscribes the barrel 1004. Adjacent to the ring 46 is a protruding cylindrical pin 48 also integrally formed with the barrel 1004. Finally, a barrel extension 50 extends to a free end of the second end 44.

Figure 10:
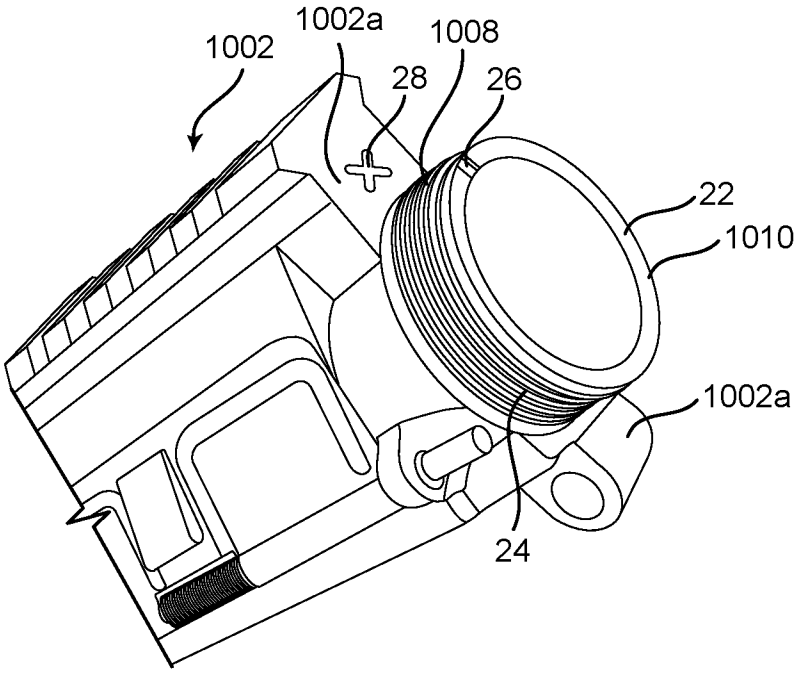
FIG. 10 is a perspective view of an upper receiver portion of a firearm.
Figure 15:
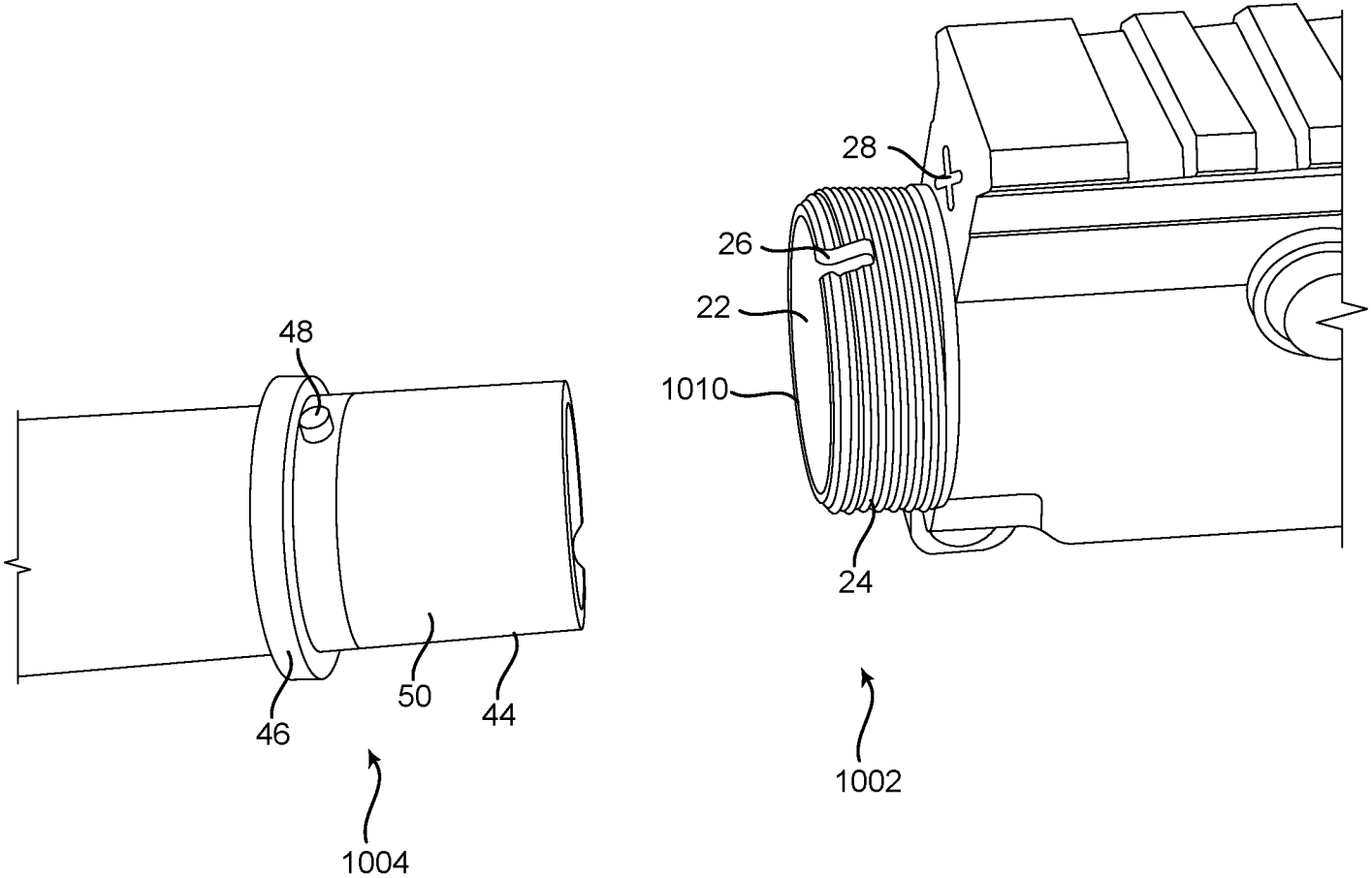
FIG. 15 is a perspective view of a barrel and an upper receiver of a firearm detached.
Figure 16:
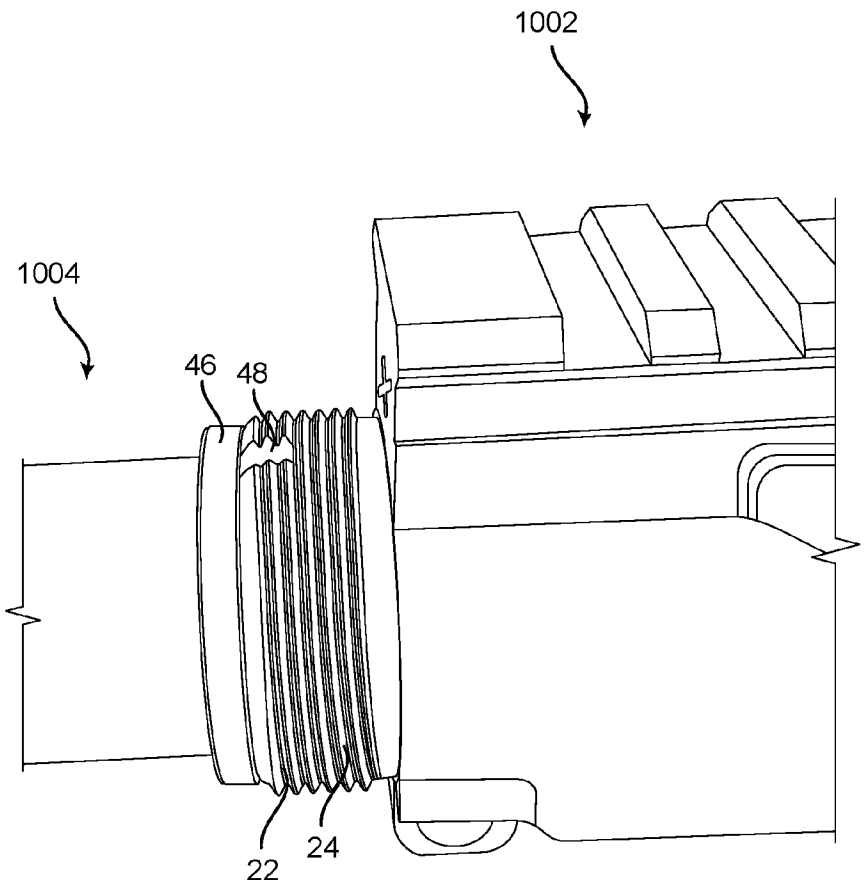
FIG. 16 is a perspective view of the barrel and upper receiver of FIG. 15 engaged.

Referring to FIGS. 10, 15 and 16, the upper receiver 1002 includes a cylindrical free end 22 having threads 24 on an outer surface thereof. A distal end 1010 of the upper receiver 1002 is a substantially flat surface normal to the threads 24. The free end 22 includes a void 26 on an upper, outermost portion of the free end 22.

Referring to FIG. 16, the firearm 1000 is normally assembled with the barrel 1004 inserted into the upper receiver 1002 free end 22, while the pin 48 is engaged with the void 26. An internally threaded barrel nut (not shown) is circumscribed around the barrel 1004 and engaged with the threads 24 of the upper receiver 1002 to provide a secure coupling of the upper receiver 1002 and the barrel 1004. The barrel 1002 is then covered with a hand guard 1050 as shown for example in FIGS. 11-13. Such an engagement is critical to the performance, function and safety of the firearm 1000 because the barrel 1004 and upper receiver 1002 are properly aligned and the bullet path is sealed. As it will be described in detail below, the barrel coupling mechanism 1 of the present invention provides the coupling configuration the firearm 1000 is designed for, i.e., engagement of the pin 48 and void 26, while also enabling a user to quickly assemble and dissemble the firearm 1000.

Figure 2:
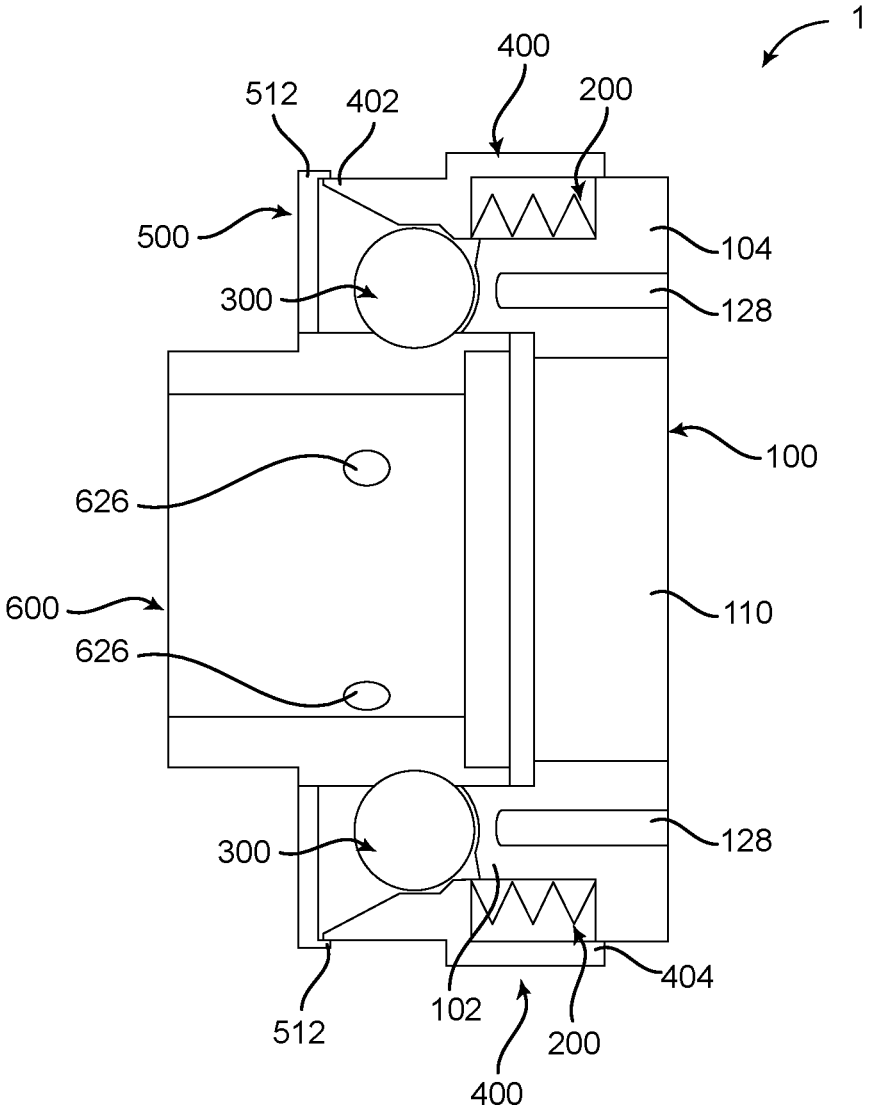
FIG. 2 is a side sectional view of the barrel coupling mechanism of FIG. 1 in an assembled state.

Referring to FIGS. 1 and 2, an embodiment of a barrel coupling mechanism or device 1 of the present invention is shown. In general, the barrel coupling mechanism 1 includes a ball bearing case 100 fixedly coupled with an upper receiver 1002 of a firearm 1000, as shown for example in FIGS. 9 and 11-13. The ball bearing case 100 is configured such that a biasing member 200 is positioned and secured at a lower end thereof. In the exemplar embodiment, the biasing member 200 is a wave spring which circumscribes the ball bearing case 100. The ball bearing case 100 includes a plurality of slots or reliefs 108 for each housing a ball bearing 300. The ball bearings 300 and biasing member 200 are further secured within and on the ball bearing case 100, respectively, by a spring sleeve 400, which circumscribes the ball bearing case 100 and is engaged with the biasing member 200. The spring sleeve 400 is self-secured onto the ball bearing case 100 by virtue of limited clearance between the spring sleeve inner end 404 and the upper receiver 1002, and limited clearance between the spring sleeve outer end 402 and the ball bearings 300. A barrel sleeve 600 is fixedly coupled on one end 602 to an end of a barrel 1004 of the firearm 1000, as shown for example in FIGS. 9 and 11-13. The barrel sleeve 600 is engaged with the ball bearing case 100 on an opposite end 604 when the device 1 is in use. The barrel sleeve 600 includes a plurality of grooves 622 for engagement with the ball bearings 300 located on the ball bearing case 100.

Referring to FIGS. 1, 2 and 3A-C, the ball bearing case 100 includes an upper member 102 and a lower member 104 integrally formed with each other, with each member 102, 104 being substantially cylindrical. The outer diameter of the lower member 104 is greater than the outer diameter of the upper member 102 such that a substantially planar upper surface 106 is formed on the lower member 104 circumscribing a lower end of the upper member 102.

Figure 3B:
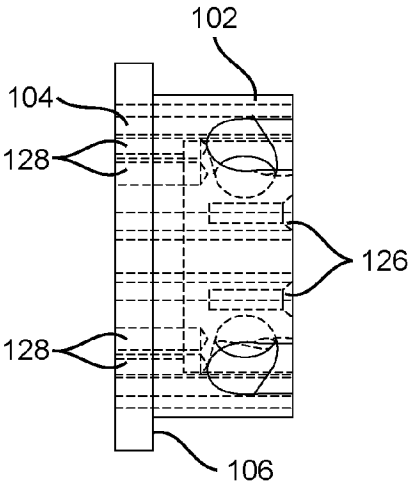
FIG. 3B is a side sectional view of the ball bearing case of FIG. 3A.
Figure 3A:
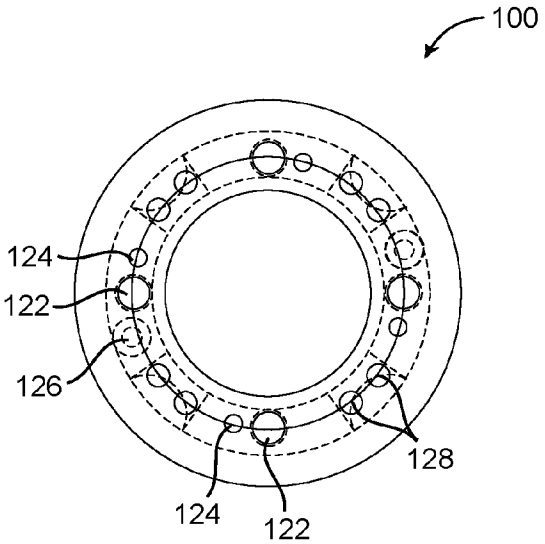
FIG. 3A is a front sectional view of a ball bearing case of the barrel coupling mechanism of FIG. 1.
Figure 3C:
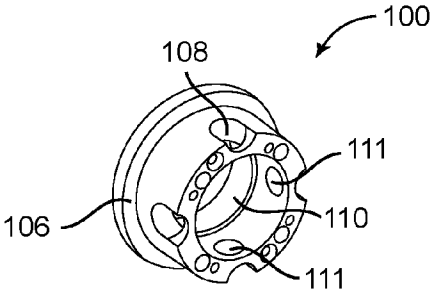
FIG. 3C is a front perspective view of the ball bearing case of FIG. 3A.

Referring to FIGS. 2-3C, an inner diameter surface 110 of a lower portion the ball bearing case 100 includes threads (not shown), which match the threads 24 of an upper receiver 1002 of a firearm 1000, as shown in FIGS. 10, 15 and 16. In this embodiment, the threads are 2B thread in order to allow for compatibility with various manufacturers of upper receivers and in consideration of threaded mating of aluminum or steel. The standard length of the threaded portion of the upper receiver is 0.445 inches. In this embodiment, the threaded portion of the inner diameter surface 110 is 0.4 inches to allow for many index positions against the upper receiver 1002, thus allowing for differences in manufacturing tolerances between different upper receivers. Also, shorter threading on the inner diameter surface 110 ensures that the entire threaded portion on the inner diameter surface 110 of the ball bearing case 100 is engaged with the upper receiver 1002 so that the barrel sleeve 600, when engaged with the ball bearing case 100 does not make contact with any threads.

Still referring to FIGS. 1, 2 and 3A-C, the upper member 102 includes a plurality of slots 108 disposed on side portions thereof. Each slot 108 extends through an outer edge of the upper member 102 forming a relief cut 109 on the outer edge. The relief cuts 109 are utilized to install the ball bearings 300, which will be described in more detail below. Each slot is configured to house a ball bearing 300 and includes an aperture 111 in which each ball bearing 300 extends partially therethrough.

The ball bearing case 100 includes a plurality of apertures 122-128, centers of which are substantially aligned radially along the circumference of the ball bearing case 100. A plurality of first apertures 122 extend through the ball bearing case 100. In this embodiment, four first apertures 122 are positioned on the ball bearing case 100 ninety degrees apart. The first apertures 122 accommodate a gas tube 1006, a shown in FIG. 11, which extends from the barrel 1004.

A plurality of second apertures 124 extend through the ball bearing case 100. In this embodiment, four second apertures 124 are positioned on the ball bearing case 100 ninety degrees apart. The second apertures 124 extend through the ball bearing case 100 and accommodate one of more set screws having dimensions sufficient to extend through the thickness of the ball bearing case 100 and make contact with the upper receiver 1002 at engagement points 1002*a*, as shown in FIG. 10. In this configuration, sufficient pressure is generated through the engagement of the set screws and the engagement points 1002*a* and reduces displacement between the ball bearing case 100 and the upper receiver 1002. At the same time, the set screws ensure that the ball bearing case 100 is concentric and aligned to the bore of the upper receiver 1002.

A plurality of third apertures 126 partially extend through the ball bearing case 100 from an upper surface 112 of the upper member 102. In this embodiment, there are two third apertures 126 positioned 180 degrees apart. The third apertures 126 accommodate fasteners (FIG. 12) for securing the face plate 500 to the ball bearing case 100.

Figure 8B:
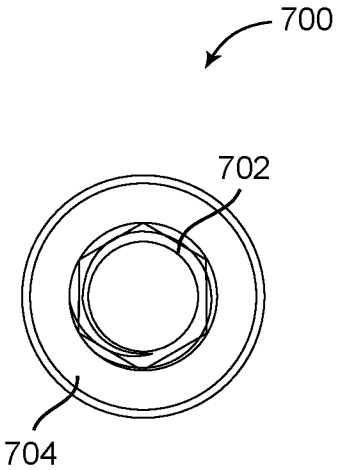
FIG. 8B is a sectional view of the set screw or stop screw of FIG. 8A.
Figure 8A:
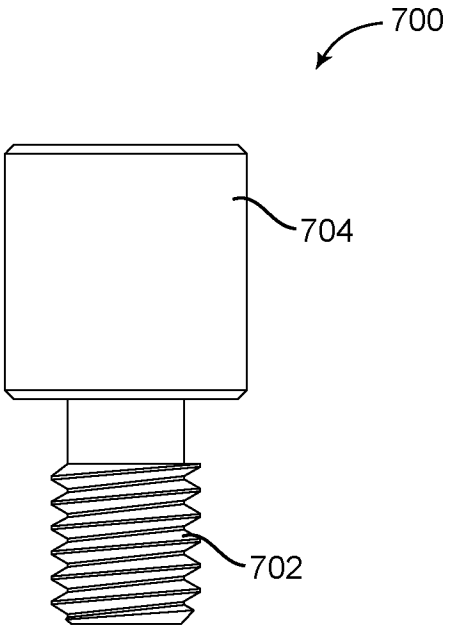
FIG. 8A is a plan view of an embodiment of a set screw or stop screw of the barrel coupling mechanism of FIG. 1.
Figure 9:
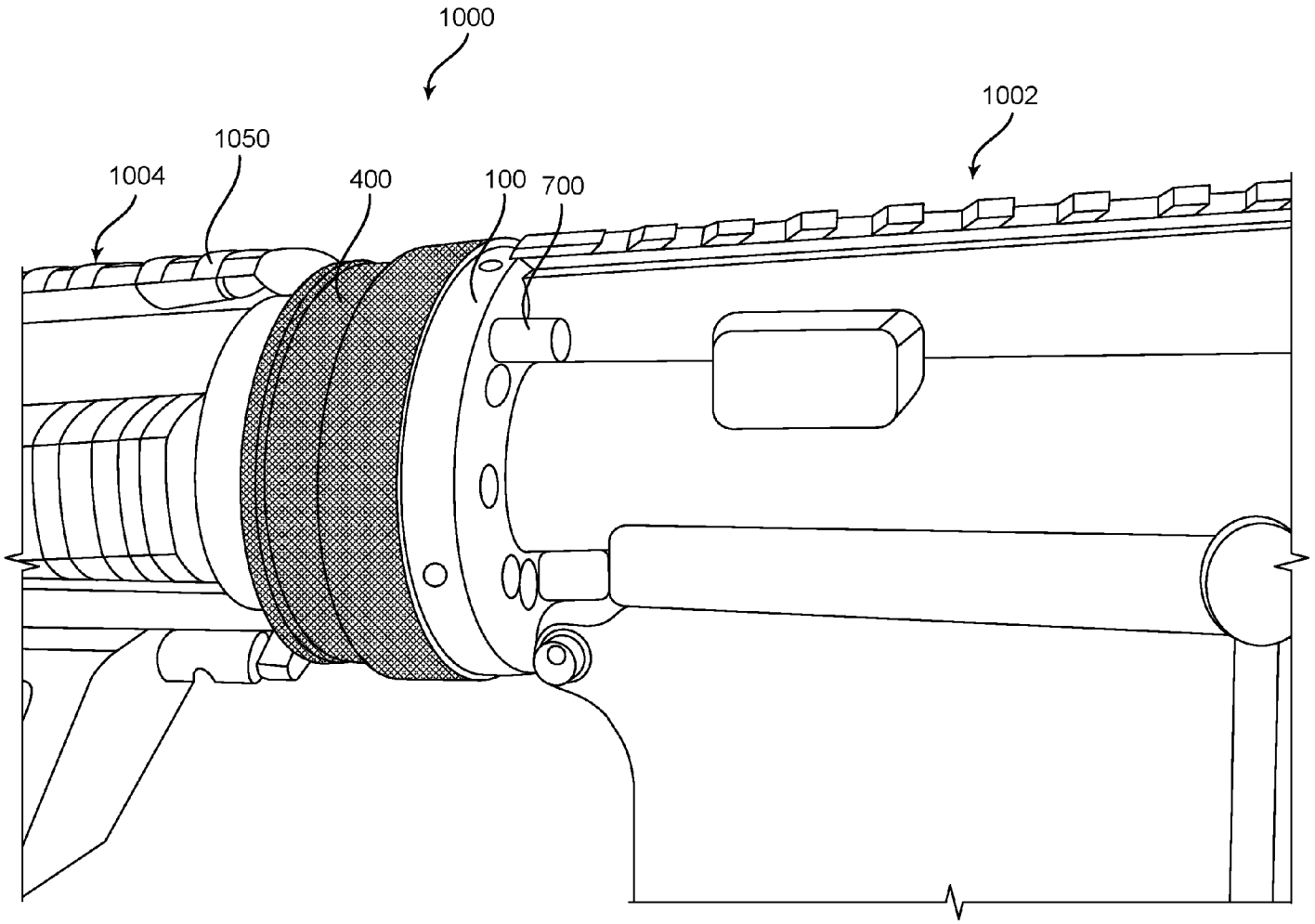
FIG. 9 is a perspective view of a firearm with the device of the present invention in an installed state.

Finally, a plurality of fourth apertures 128 partially extend through the ball bearing case 100 from a lower surface 114 of the lower member 104. In this embodiment, four pairs of fourth apertures 128 are positioned ninety degrees from each other. The fourth apertures 128, shown in FIGS. 3A and 3C, extend partially through the ball bearing case 100. One or more set screws 700, as shown in FIGS. 8A and 8B, could be fixed to one or more fourth apertures 128 and against the sides of the upper receiver 1002 such that the ball bearing case 100 is prevented from rotating after it is installed, as shown in FIG. 9. As such, even though the fourth apertures 128 are exposed, because they do not extend through the ball bearing case 100, there is no risk of dust or debris entering the barrel through these apertures 128. Any unused apertures 122-128 could be sealed with additional fasteners.

The ball bearing case 100 could also be provided with radially extending auxiliary holes 130 as shown in FIG. 12. Fasteners could be installed to further secure the ball bearing case 100 to the upper receiver 1002.

Figure 4A:
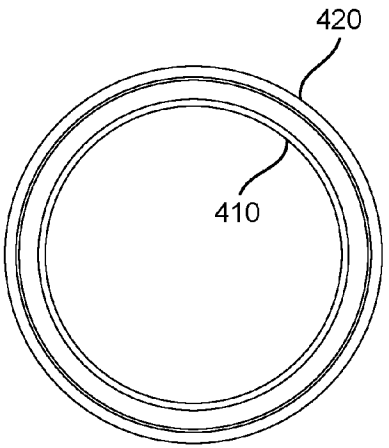
FIG. 4A is a top view of a spring sleeve of the barrel coupling mechanism of FIG. 1.
Figure 4B:
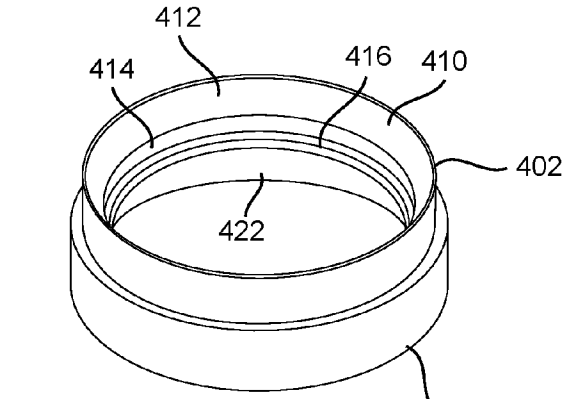
FIG. 4B is a top perspective view of the spring sleeve of FIG. 4A.
Figure 4C:
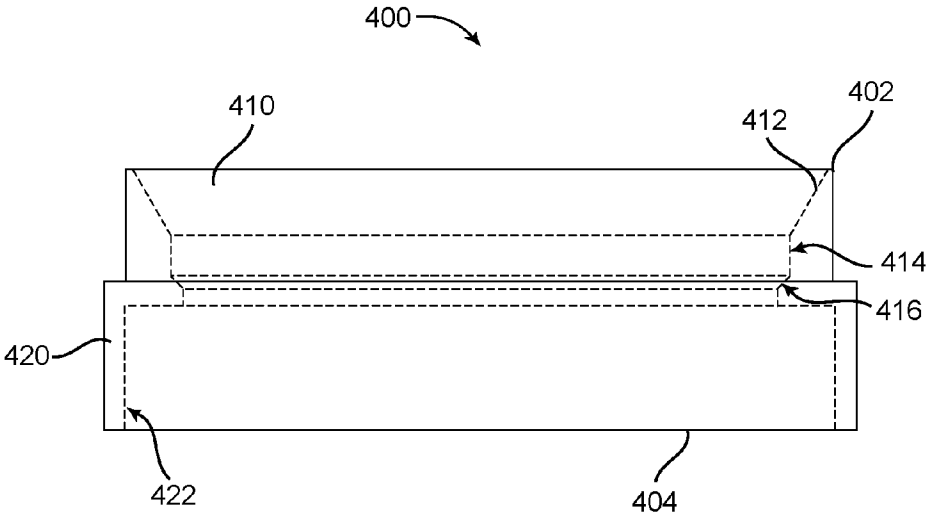
FIG. 4C is a sectional view of the spring sleeve of FIG. 4A.

Referring now to FIGS. 4A-4C, the spring sleeve 400 of the present invention is shown. The spring sleeve 400 is configured to circumscribe the ball bearing case 100 and to secure the ball bearings 300 on the ball bearing case 100, as shown in FIG. 2. The spring sleeve 400 is generally cylindrical and includes an upper member 410 and a lower member 420 integrally formed together, with the diameter of the upper member 410 being less than the diameter of the lower member 420. The upper member 410 includes an upper portion 412 that is tapered so that when the spring sleeve 400 is retracted the ball bearings 300 are displaced from the slots 108. A mid portion 414 of the upper member 410 includes a substantially smooth surface. The mid portion 414 is constructed with tolerances for the spring sleeve 400 to be slidingly engaged with the ball bearing 300 while providing sufficient friction to remain engaged when the device 1 is engaged and the firearm 1000 is in use. With such tolerances, sheering of the slots 108 of the ball bearing case 100 is prevented and any cracking of the spring sleeve 400 is avoided as well. A lower portion 416 of the upper member 410 includes a notch or chamfer. The notch or chamfer 416 allows the spring sleeve 400 to engage the ball bearings 300 with sufficient force inwards toward the bore of the barrel, creating a solid lock while ensuring that the barrel of the firearm is concentric and aligned with the upper receiver 1002. The notch or chamfer of the lower portion 416 also aids in reducing wear on the device 1 by eliminating vibration. Lastly, the notch or chamfer serves to retain the spring sleeve 400 on the device 1 during installation of the device 1.

That is, the notch or chamfer 416 provides a mechanism for remaining engaged with the ball bearing 300 and within the device 1 without disengaging from the device 1 due to the force from the biasing member 200. Also, as described in more detail below, the notch or chamber 416 also provides a retaining means for the spring sleeve 400 after assembly of the device 1 such that the spring sleeve 400 is independently retained on the device 1 without other components securing the same.

In this configuration, the portions 412, 414, 416 of the upper member 410 engage the ball bearings 300 at all times, i.e., during assembly and disassembly of the device 1. The lower member 420 is sized such that an inner portion 422 is engaged with an outer portion of the ball bearing case 100 at all times, as shown for example in FIG. 2, thus preventing dust and debris from entering the device 1.

Figure 5B:
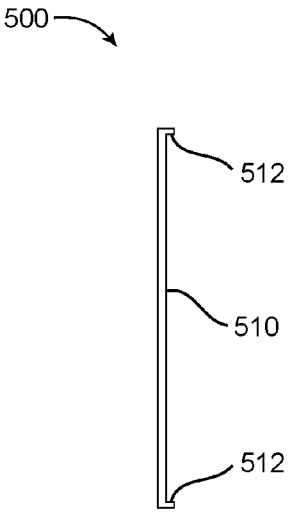
FIG. 5B is a side sectional view of the face plate of FIG. 5A.
Figure 5C:
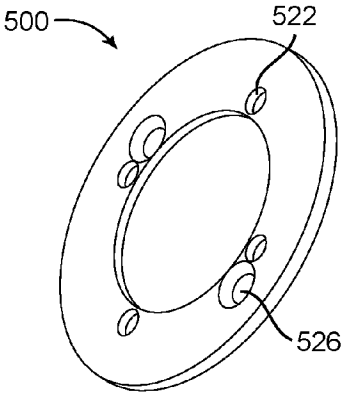
FIG. 5C is a top perspective view of the face plate of FIG. 5A.
Figure 5A:
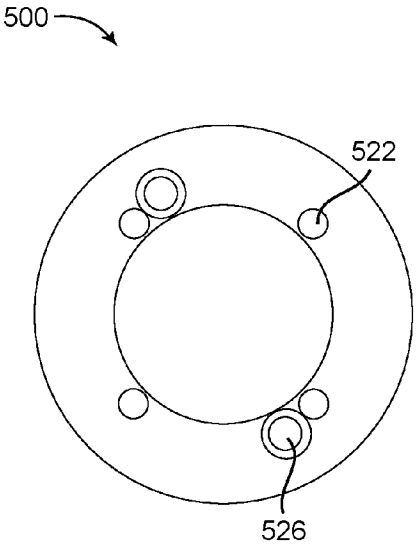
FIG. 5A is a top view of a face plate of the barrel coupling mechanism of FIG. 1.

Referring now to FIGS. 5A-5C, the face plate 500 of the present invention is shown. The face plate 500 includes a plurality of fifth apertures 522 extending therethrough. In the figures, four fifth apertures 522 shown for illustrative purposes only, and positioned on the face plate 500 ninety degrees apart, which correspond to and are aligned with the first apertures 122 of the ball bearing case 100. The fifth apertures 522 accommodate a gas tube 1006 which extends from the barrel 1004. In real-life application, however, only one aperture 522 is necessary to accommodate the gas tube 1006 at or about the twelve o'clock position. Any unused apertures could be sealed with fasteners. The face plate 500 also includes a plurality of sixth apertures 526 extending therethrough. In this embodiment, there are two sixth apertures 526 positioned 180 degrees apart. The sixth apertures 526 accommodate fasteners (FIG. 12) for securing the face plate 500 to the ball bearing case 100 via the third apertures 126. A bottom section 510 of the face plate 500 includes and extension or lip 512 which circumscribes the face plate 500. The lip 512 provides a seal to the inner components of the device 1, as shown in FIG. 2, whether or not the barrel sleeve 600 is engaged with the ball bearing case 100. Such a seal acts as a dust cover and prevents dust and debris from entering the device 1. The lip 512 also assists in reducing vibration of the biasing member 200 when the firearm 1000 is fired. By reducing vibration of the biasing member 200, not only is noise reduced but premature wear of the spring sleeve 400 mating surface is reduced as well.

Figure 6C:
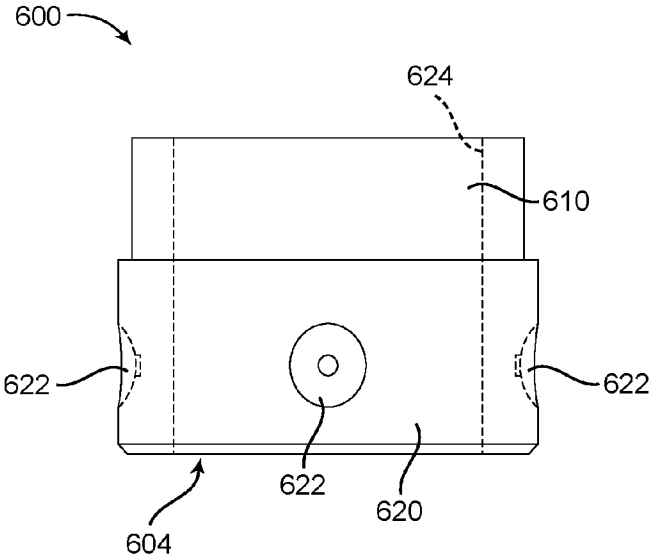
FIG. 6C is a side sectional view of the barrel sleeve of FIG. 6A.
Figure 6B:
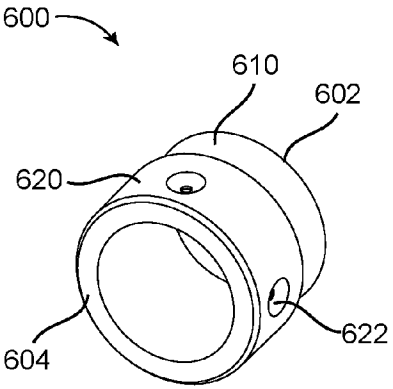
FIG. 6B is a front perspective view of the barrel sleeve of FIG. 6A.
Figure 6A:
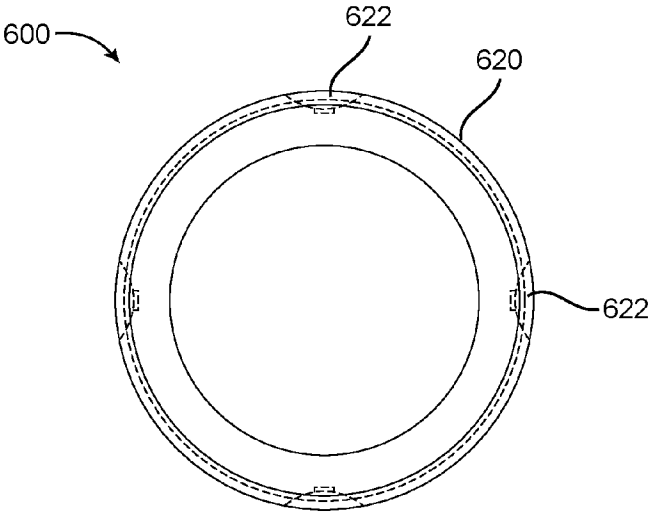
FIG. 6A is a sectional view of a barrel sleeve of the barrel coupling mechanism of FIG. 1.
Figure 19:
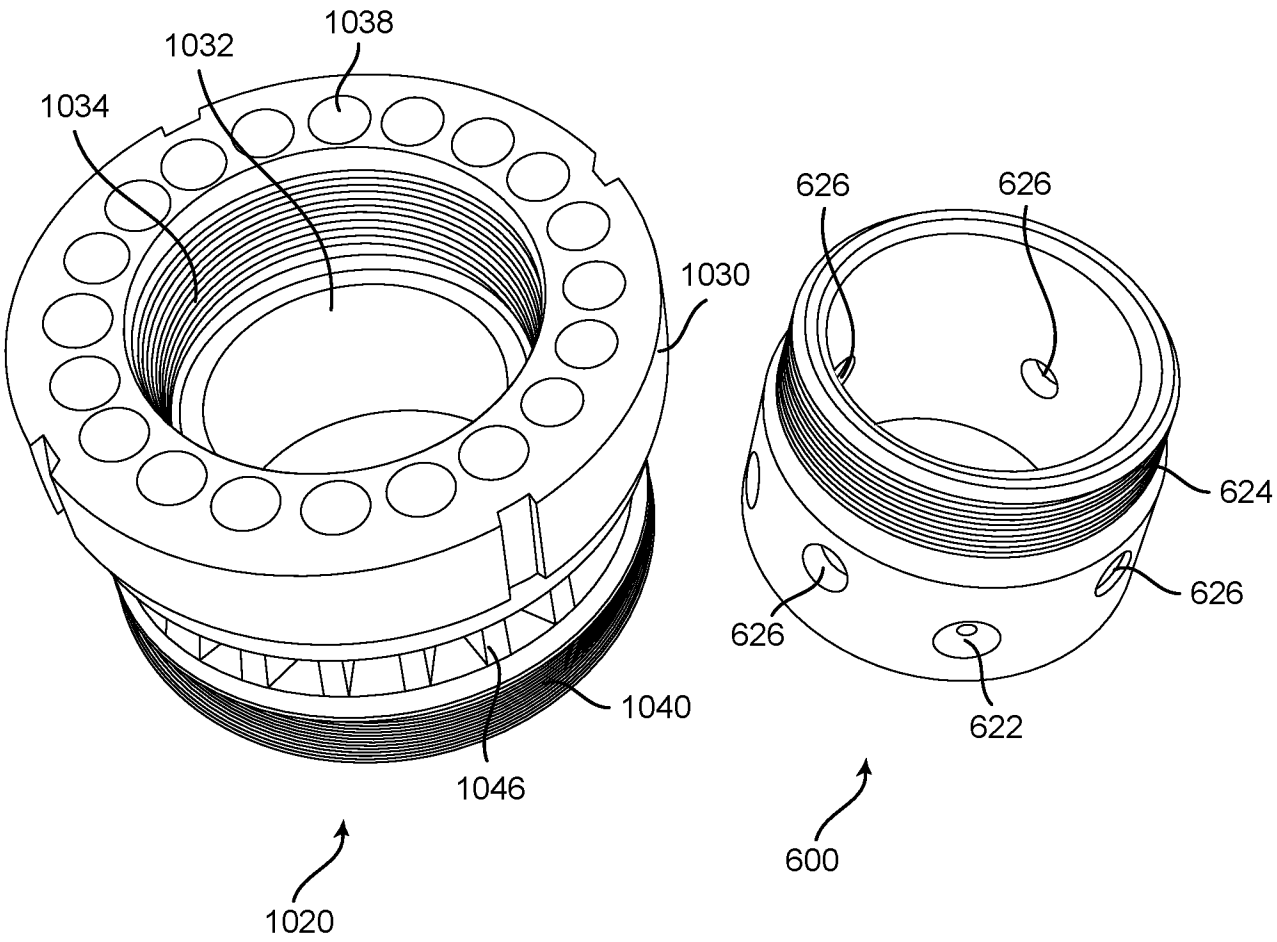
FIG. 19 are perspective views of a an embodiment of a barrel nut and the barrel sleeve of the previous figures.
Figure 20:
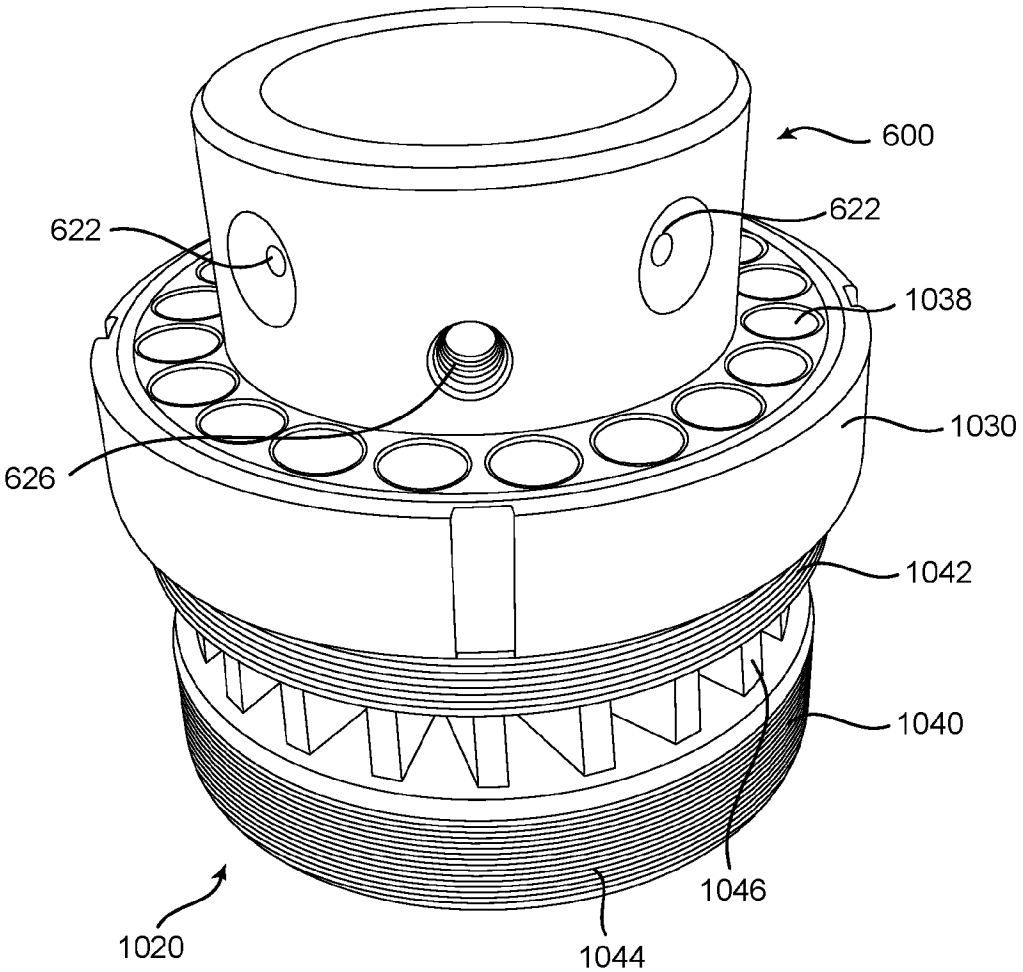
FIG. 20 is a perspective view of the barrel nut and barrel sleeve shown in FIG. 19 in an engaged state.

Referring now to FIGS. 6A-6C, the barrel sleeve 600 of the present invention is shown. The barrel sleeve 600 comprises a substantially cylindrical inner section 610 and a substantially cylindrical outer section 620 integrally formed with each other. The outer diameter of the inner section 610 is less than the outer diameter of the outer section 620, while the inner diameters of each section 610, 620 are substantially the same. An outer surface of the inner section 610 includes threads 624. In this embodiment, the threads 624 are 1¼-18 2B. An outer surface of the outer section 620 includes a plurality of grooves 622 which engage with ball bearings 300 when the device 1 is in use, as shown in FIG. 2. In the present embodiment, the barrel sleeve 600 includes four grooves 622, each radially aligned and positioned ninety degrees apart along the outer surface of the outer section 620. The position of the grooves 622 correspond to the position of the ball bearings 300. However, the number of grooves could be increased with an increased number of ball bearings depending on application and design. The barrel sleeve 600 could be provided with auxiliary holes 626, as shown in FIGS. 12 and 19, to further secure the barrel sleeve 600 to the barrel 1004 via fasteners. Also, the outer end 604 could be modified, for example by cutting or shimming to ensure proper engagement of the barrel sleeve 600 and the ball bearing case 100. This adjustment would depend on the threading provided on the upper receiver 1002 and barrel 1004 of the firearm 1000. Thus, proper head spacing could be achieved to provide reliability and accuracy of the firearm 1000.

Figure 7:
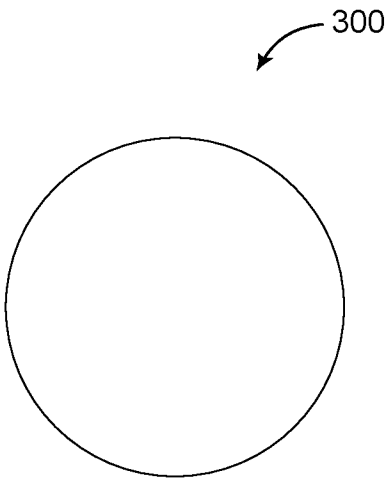
FIG. 7 is a plan view of an embodiment of a ball bearing of the barrel coupling mechanism of FIG. 1.

Referring to FIG. 7, a ball bearing 300 of the present invention is shown. The ball bearing 300 is sized in accordance with the size of the slots 108 of the ball bearing case 100 and the grooves 622 of the barrel sleeve 600.

Referring now to FIGS. 8A and 8B, an embodiment of a set screw 700 of the present invention is shown. In the preferred embodiment, the set screw 700 is configured for engagement with a hex key or allen wrench, but the screw 700 could be configured to work with other devices such as but not limited to screw drivers. The set screw 700 includes a threaded portion 702 and an engagement portion 704. As described above, the set screw 700 could be utilized to further secure the ball bearing case 100 to the upper receiver 1002 of the firearm 1000. That is, one or more set screws 700 could be applied through the second or fourth apertures 124, 128 of the ball bearing case 100 and engaged with sides of the upper receiver 1002, as shown in FIG. 9, to prevent the ball bearing case 100 from rotating while installed. Other set screws or fasteners could be used to further secure the components of the device 1. For example, a smaller fastener 710 could be used to secure the barrel sleeve 600 to the barrel 1004, as shown in FIG. 12. Similar fasteners could be inserted into apertures 130 (as shown in FIG. 12) in the ball bearing case 100 to further secure the ball bearing case 100 to the upper receiver 1002.

Figure 21:
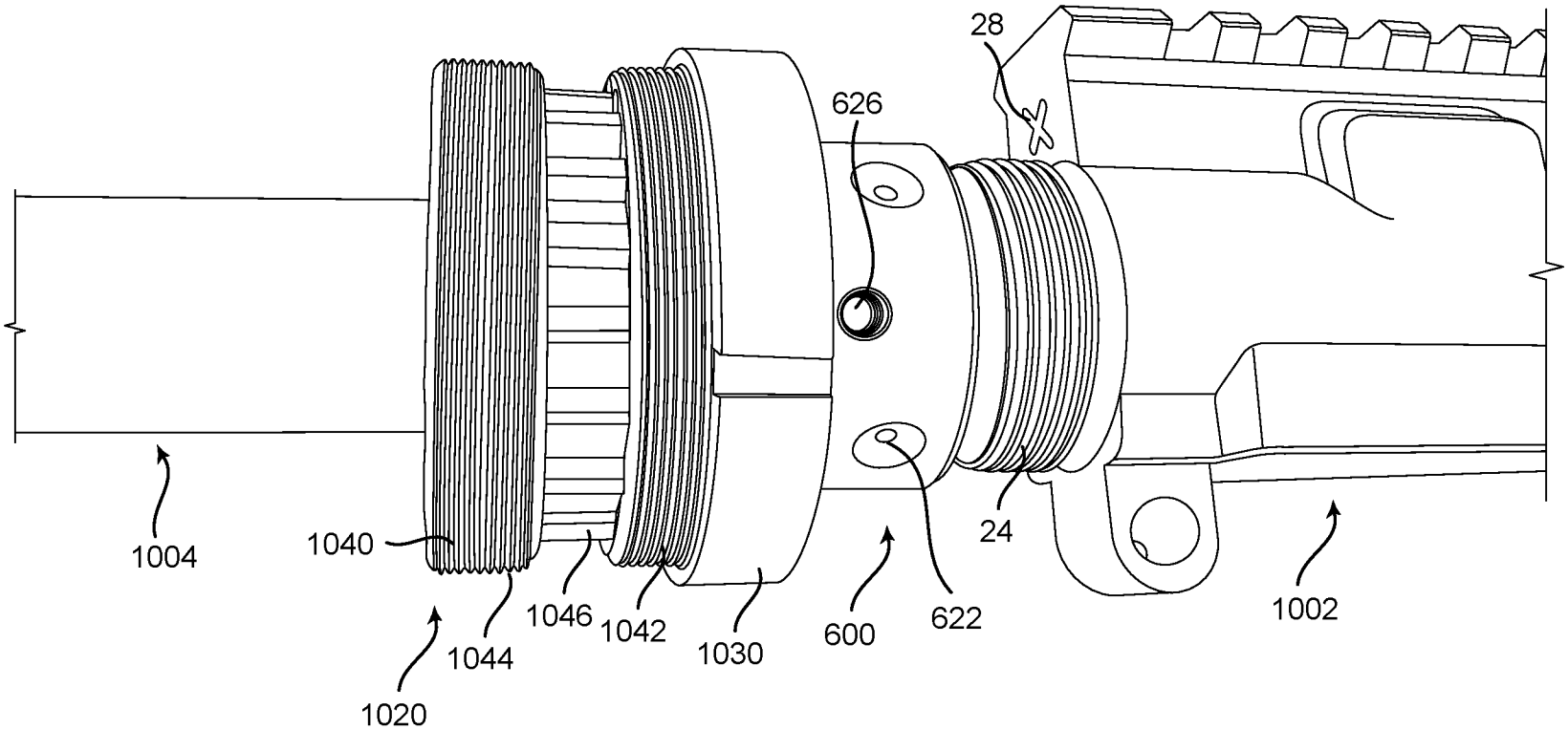
FIG. 21 is a plan view of the engaged barrel nut and barrel sleeve of FIG. 20 partially attached to the barrel of FIG. 14 with the upper receiver and barrel engaged.
Figure 22:
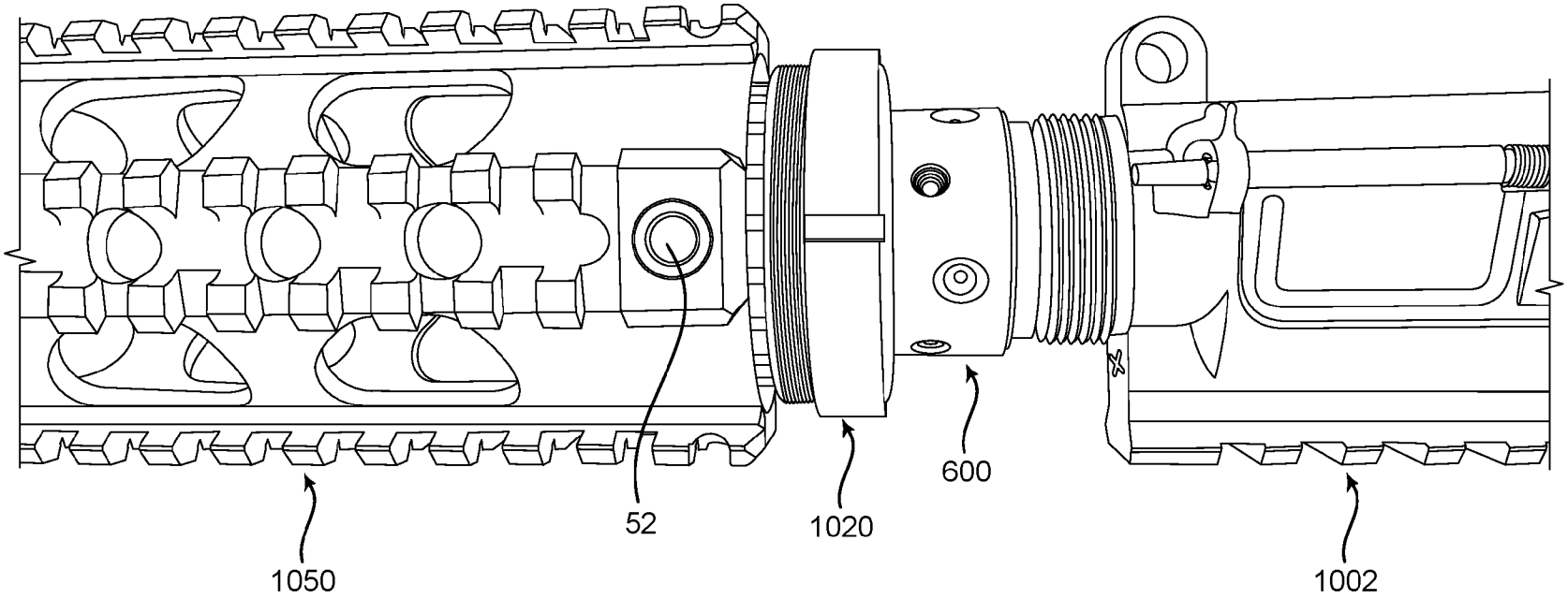
FIG. 22 is a plan view of a hand guard partially attached to the barrel nut of the previous figures.

Referring to FIG. 19-22, a barrel nut 1020 is shown. In this embodiment, the barrel nut 1020 is substantially cylindrical and includes a top section 1030 and a bottom section 1040. The inner diameter of the top section 1030 is less than the inner diameter of the bottom section 1040 while the outer diameter of the top section 1030 is greater than the outer diameter of the bottom section 1040 such that a ridge 1032 is formed therebetween. The top section 1030 includes threads 1034 on an inner surface while an outer surface is substantially smooth. In this embodiment, a portion 1036 between the inner surface and outer surface of the top section 1030 include a plurality of apertures 1038. As described in more detail below, the inner threads 1034 match the outer threads 624 of the barrel sleeve 600 and the apertures 1038 are sized sufficient for the gas tube 1006 pass through. An inner surface of the bottom section 1040 is substantially smooth while an outer surface includes a first threaded portion 1042 and a second threaded portion 1044 with a plurality of ribs 1046 therebetween. The threaded portions 1042, 1044 are sufficient to match threads of a hand guard 1050, as shown in FIG. 22. In other embodiments, the barrel nut 1020 could be provided without a larger top section so that the gas tube could pass freely above the barrel nut. Also, the barrel nut could be provided with a detent rather than a threaded outer section to accommodate for hand guards without threads.

The device 1 is installed on a firearm 1000 by attaching the ball bearing case 100 to the upper receiver 1002 of the firearm 1000, and the barrel sleeve 600 to the barrel 1004 of the firearm 1000.

The ball bearing case 100 is coupled to the upper receiver 1002 by threaded engagement. Initially, the internal threads 110 of the ball bearing case 100 are only partially threaded onto the threads 24 of the upper receiver 1002 free end 22. The biasing member 200 is positioned on top of the lower member 106 of the ball bearing case 100. Then the spring sleeve 400 is positioned above the biasing member 200. Because the ball bearing case 100 is only partially secured to the upper receiver 1002, additional clearance is formed between the spring sleeve inner end 404 and the upper receiver 1002. The spring sleeve 400 is engaged or retracted toward the lower member 102 of the ball bearing case 100 by compressing the biasing member 200. Due to the additional clearance formed by only partially securing the ball bearing case 100 to the upper receiver 1002, the spring sleeve outer end 402 is extended at least partially beyond the relief cuts 109 of the ball bearing case 100, providing sufficient clearance between the same such that the clearance distance exceeds the diameter of the ball bearing 300. While in this position, each ball bearing 300 is inserted and positioned within corresponding slots 108. Once the ball bearings 300 are properly positioned, the spring sleeve 400 is disengaged and the biasing member 200 is extended, thus, the ball bearings 300 are engaged and secured between the spring sleeve 400 and ball bearing case 100.

The ball bearing case 100 is then further threaded onto the upper receiver 1002 and completely coupled to the upper receiver 1002 such that at least one first aperture 122 is positioned at a top portion of the upper receiver 1002 and aligned with the gas tube 1006, which normally extends from a top portion of the barrel 1004. An adhesive or sealant (generally referred to as a threadlocker), such as LOCTITE, could be applied to the threaded engagement. Set screws are engaged with the second apertures 124 and extended through the ball bearing case 100 and secured to the engagement points 1002*a* of the upper receiver 1002.

One or more set screws 700 are fixed to one or more fourth apertures 128 and against the sides of the upper receiver 1002 such that the ball bearing case 100 is prevented from rotating about the upper receiver 1002.

The apertures of the face plate 500 are aligned with the corresponding apertures of the ball bearing case 100. In particular a fifth aperture 522 is aligned with the first aperture 122 at a top portion of the upper receiver 1002 so that each aperture 122, 522 is capable of receiving the gas tube 1006. The face plate 500 is coupled with the ball bearing case 100 with fasteners (not shown) extending through the third and sixth apertures 126, 526.

Figure 17:
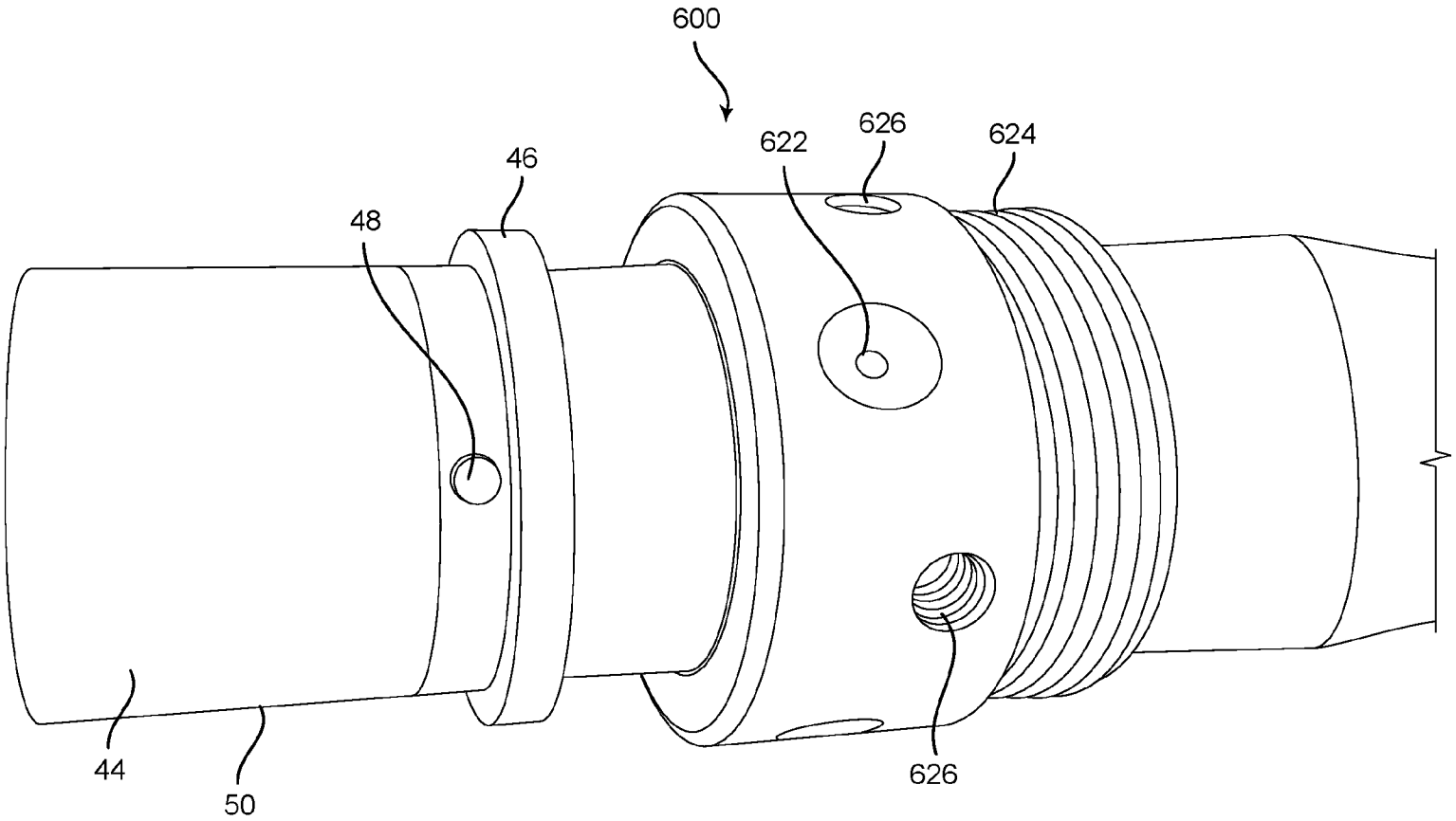
FIG. 17 is a perspective view of the barrel sleeve of FIGS. 6A-6B engaged with the barrel of the previous figures in a first partially attached state.
Figure 18:
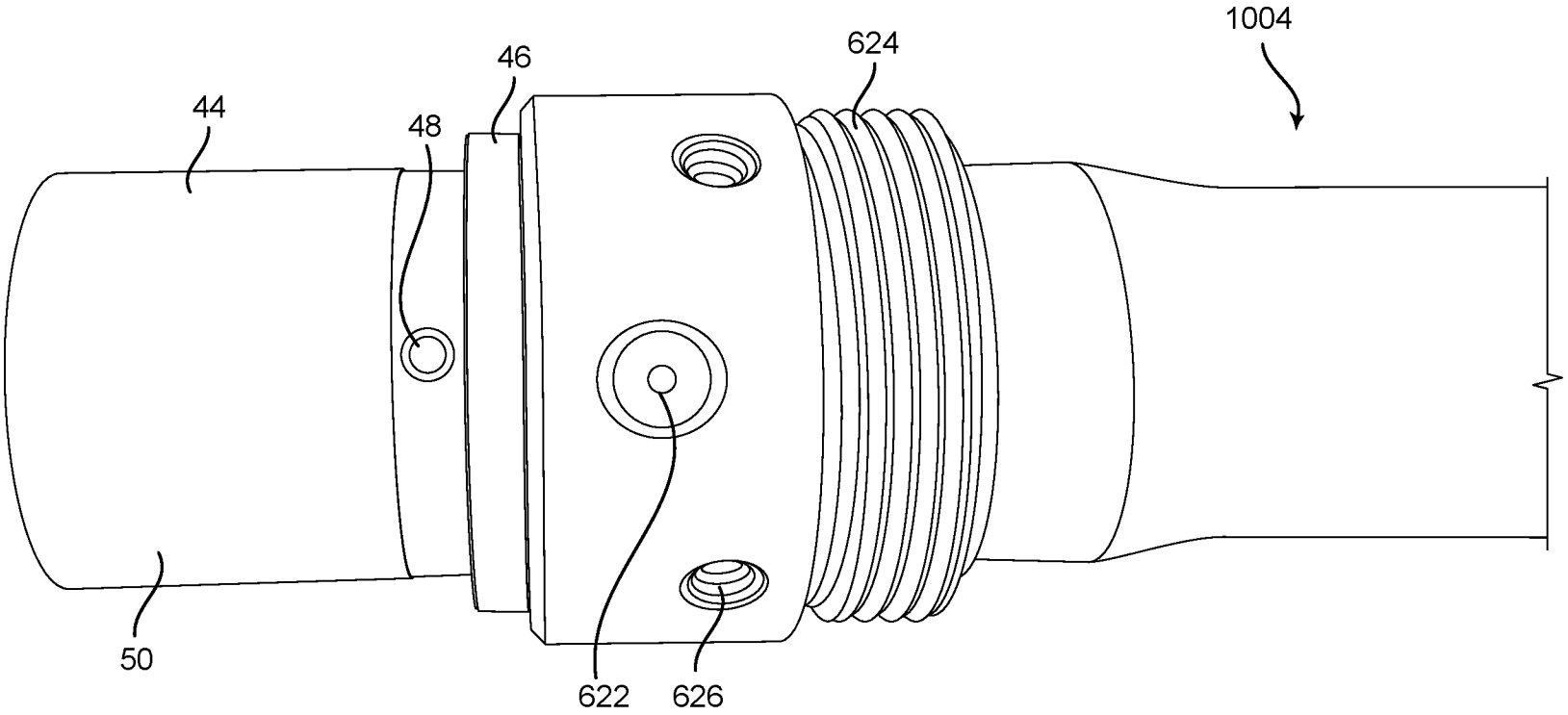
FIG. 18 is a perspective view of the barrel sleeve of FIGS. 6A-6B engaged with the barrel of the previous figures in a second partially attached state.

Referring to FIGS. 17-22, the barrel sleeve 600 is inserted onto the barrel 1004 from the first end 42 and slid to the second end 44 of the barrel 1004 until the barrel sleeve outer end 604 abuts the ring 46 of the barrel 1004, as shown in FIGS. 17 and 18. Similarly, the barrel nut 1020 is inserted onto the barrel 1004 from the first end 42 and slid to the second end 44 where the barrel nut 1020 is coupled with the barrel sleeve 600 by threaded engagement between the barrel nut inner threads 1034 and the barrel sleeve outer threads 624, as shown for example in FIGS. 20-22. The rotational position of the barrel sleeve 600 is predetermined, i.e., the installer could mark the barrel sleeve 600 based on a predetermined rotational position of the ball bearing case 100 so that the slots 108 of the ball bearing case 100 and the grooves 622 of the barrel sleeve 600 are properly aligned. Set screws are fixed within set screw holes 626 of the barrel sleeve 600 and engaged with the barrel 1004 to secure the barrel sleeve 600. As shown in FIG. 21, the barrel extension 50 is inserted into the upper receiver free end 22 such that the pin 48 and void 26 are engaged. While in this configuration, the barrel nut 1020 is adjusted such that an aperture 1038 thereof is aligned with the gas tube channel 28 on the upper receiver 1002. The hand guard 1050 is attached to the barrel nut 1020 by threaded engagement. The hand guard 1050 could be further secured to the barrel nut 1020 with a set screw extending through an aperture 52 (FIG. 22) which can engage a rib 1046 or the barrel 1004. An adhesive or sealant (generally referred to as a threadlocker), such as LOCTITE, could be applied to the threaded engagements prior to engagement.

Referring to FIGS. 2, 9 and 11-13, in operation, after installation of the components as described above, the firearm barrel 1004 is coupled to the upper receiver 1002 of the firearm 1000 by connecting the barrel sleeve 600 to the ball bearing case 100. Specifically, the spring sleeve 400 is retracted while the barrel sleeve 600 is inserted into the ball bearing case 100. In this position, the ball bearings 300 are displaced outward while the barrel sleeve 600 engages the displaced ball bearings 300. However, now due to the ball bearing case 100 having been completely threaded onto and secured to the upper receiver 1002, the clearance formed between the spring sleeve outer end 402 and the relief cuts 109 is less than the diameter of the ball bearings 300. Thus, the ball bearings 300 are displaced from the slots 108 but still secured between the spring sleeve 400 and the ball bearing case 100. The gas tube 1006 extending from the barrel is inserted into corresponding fifth and first apertures 522, 122 of the face plate 500 and ball bearing case 100, respectively. The barrel sleeve 600 is positioned within the ball bearing case 100 such that the grooves 622 are radially aligned with the ball bearings 300 and the slots 108. At the same time, the barrel pin 48 is inserted into the upper receiver void 26, as shown in FIG. 16. The spring sleeve 400 is disengaged and the device 1 is secured into a fully assembled firearm. The steps described above are reversed to disassemble the firearm 1000. The presence of the various features of the device 1, namely for example, the notch 416 of the spring sleeve 400 and the relief cuts 109, provides for a smooth, effortless assembly and disassembly of the device 1.

The components of the device 1 described could be manufactured with a number of high-strength materials such as stainless steel, 4140 high tensile steel, B7 alloy steel and titanium. One of ordinary skill in the art will recognize that other materials could be used as well.

In the embodiment illustrated in the figures, the barrel coupling mechanism 1 can be used on an M-16 rifle. The M16 rifle is a gas-operated rifle having a bolt and bolt carrier. Typically, the M16 is configured to fire .223 caliber rounds or other comparable rounds, such as, by way of example, 5.56×45 mm NATO rounds. For the purposes of this disclosure, the term "firearm" generally refers to said rifles as well as similar modular rifles and other variants. One example variant of the M-16 is the AR-15 rifle, which is the semiautomatic civilian version of the M-16. Other example variants of the M-16 include rifles identified by the following appellations: XM16, XM16E1, M16A1, M16A2, M16A2E1, M16A2E2, M16A2E3, M16A2E4, M16A3, M116A4, XM177, XMI77E1, XM177E2, CAR-15, M4 Carbine, M4A1 Carbine, M4E2, M4 MWS, Mk 4 Mod 0, M231, M231 FPW, KH2002, S5.56, MSSR, NORCINCO, M311/CQ, M14, M14 SMUD, GUU-5/P, Diemaco C7, Diemaco C8, SDM-R, SAM-R, Mark 11 SWS, Mark 12 SPR, SEAL Recon Rifle, Mark 18 CQBR, Ares Shrike, La France M16K, M249, XM8, MK16, FN SCAR Colt Commando, Colt Models 601, 602, 603, 604, 645, 645E, 646, 655, 656, 723, 725, 733, 920, 921, 921 HB, 925 and 945. Other variants include the AR-10/SR-25 rifle system in, for example, 7.62 mm/.308 caliber. Still other variants that are known now or are developed later are intended to be included within the scope of the term "firearm," as understood by a person of skill in the art.

The present invention may be embodied in other specific forms without departing from its spirit or essential characteristics. The described embodiments are to be considered in all respects only as illustrative and not restrictive. The scope of the invention will be, therefore, indicated by claims rather than by the foregoing description. All changes, which come within the meaning and range of equivalency of the claims, are to be embraced within their scope.

The invention claimed is:

1. A modular firearm system comprising:

an upper receiver, the upper receiver having a free end, the free end having first threads circumscribing an outer section thereof, the free end having a void positioned at an outermost portion thereof;

a bearing case comprising an upper member and a lower member, the upper member having an outer diameter less than an outer diameter of the lower member such that an upper surface is formed therebetween, the upper member having a plurality of slots formed therein, the lower member having second threads circumscribing an inner section thereof, the bearing case operably coupled to the upper receiver free end by engagement of the first and second threads;

a biasing member positioned on the upper surface of the bearing case;

a plurality of bearings, each bearing positioned within each slot;

a spring sleeve circumscribing the bearing case, biasing member and bearings, the spring sleeve being engaged with the biasing member;

a face plate positioned adjacent to the bearing case and fixedly coupled thereto, the face plate engaging the spring sleeve such that the biasing member and bearings are enclosed within the spring sleeve and face plate;

a barrel having a first end and an opposing second end and a ring therebetween, a pin extending from the barrel between the ring and the second end;

a barrel sleeve comprising an inner section and an outer section, the inner section having third threads circumscribing an outer portion thereof, the outer section having a plurality of grooves positioned on an outer portion thereof, the barrel sleeve circumscribing the barrel and positioned adjacent the ring between the barrel first end and the ring such that the barrel sleeve outer section engages the ring;

a barrel nut having fourth threads circumscribing an inner section thereof and fifth threads circumscribing an outer section thereof, the barrel nut circumscribing the barrel and positioned between the first end and the barrel sleeve, the barrel nut operably coupled with the barrel sleeve by engaging the third and fourth threads;

wherein in an engaged state, the barrel sleeve is positioned within the bearing case such that each bearing is positioned within a corresponding groove and the pin is positioned within the void such that the upper receiver and barrel are substantially aligned.

2. The modular firearm system of claim 1, wherein each slot of the bearing case extends through the upper member such that a corresponding bearing is at least partially extendable therethrough.

3. The modular firearm system of claim 1, wherein the spring sleeve comprises an upper member integrally formed with a lower member, the upper member having inner and outer diameters less than that of the lower member, the upper member having in inner surface comprising tapered upper and lower portions with a mid portion therebetween, the mid portion being substantially parallel with an outer surface of the upper member, the tapered lower portion engageable with the bearings.

4. The modular firearm system of claim 1, wherein the face plate comprises a lip extending along an outer edge thereof, the lip engageable with the spring sleeve upper member to form a substantial seal.

5. The modular firearm system of claim 1, wherein the barrel sleeve further comprises at least one aperture extending radially therethrough such that a fastener is secured therein and fixed on the barrel.

6. The modular firearm system of claim 1, wherein the bearing case lower member further comprises at least one aperture extending axially at least partially therethrough such that a fastener is secured therein.

7. A modular firearm system comprising:

an upper receiver, the upper receiver having a free end, the free end having first threads circumscribing an outer section thereof, the free end having a void positioned at an outermost end;

a bearing case comprising an upper member and a lower member, the upper member having an outer diameter less than an outer diameter of the lower member such that an upper surface is formed therebetween, the upper member having a plurality of slots formed therein, each slot extending through the upper member to form a slot aperture, the lower member having second threads circumscribing an inner section thereof, the bearing case operably coupled to the upper receiver free end by engagement of the first and second threads;

a biasing member positioned on the upper surface of the bearing case;

a plurality of bearings, each bearing positioned within each slot and partially extendable through the slot aperture;

a spring sleeve circumscribing the bearing case, biasing member and bearings, the spring sleeve being engaged with the biasing member;

a face plate positioned adjacent to the bearing case and fixedly coupled thereto, the face plate engaging the spring sleeve such that the biasing member and bearings are enclosed within the spring sleeve and the face plate;

a barrel having a first end and an opposing second end and a ring therebetween, a pin extending from the barrel between the ring and the second end;

a barrel sleeve comprising an inner section and an outer section, the barrel sleeve operably coupled to the barrel proximate the barrel second end, the outer section having a plurality of grooves positioned on an outer portion thereof;

wherein in an engaged state, the barrel sleeve is positioned within the bearing case such that each bearing is positioned within a corresponding groove and the pin is positioned within the void such that the upper receiver and barrel are substantially aligned.

8. The modular firearm system of claim 7, wherein the barrel sleeve inner section includes third threads circumscribing an outer portion thereof.

9. The modular firearm system of claim 8, wherein the barrel sleeve circumscribes the barrel and is positioned adjacent the ring between the barrel first end and the ring, the barrel sleeve operably coupled with the barrel.

10. The modular firearm system of claim 9, further comprising a barrel nut having fourth threads circumscribing an inner section thereof and fifth threads circumscribing an outer section thereof, the barrel nut circumscribing the barrel and positioned between the first end and the barrel sleeve, the barrel nut operably coupled with the barrel sleeve by engaging the third and fourth threads.

11. The modular firearm system of claim 7, wherein the spring sleeve comprises an upper member integrally formed with a lower member, the upper member having inner and outer diameters less than that of the lower member, the upper member having in inner surface comprising tapered upper and lower portions with a mid portion therebetween, the mid portion being substantially parallel with an outer surface of the upper member, the tapered lower portion engageable with the bearings.

12. The modular firearm system of claim 11, wherein the face plate comprises a lip extending along an outer edge thereof, the lip engageable with the spring sleeve upper member to form a substantial seal.

13. The modular firearm system of claim 7, wherein the barrel sleeve further comprises at least one barrel sleeve aperture extending radially therethrough such that a fastener is secured therein and fixed on the barrel.

14. The modular firearm system of claim 7, wherein the bearing case lower member further comprises at least one bearing case aperture extending axially at least partially therethrough such that a fastener is secured therein.

15. A modular firearm system comprising:

an upper receiver having a free end;

a bearing case operably coupled to the upper receiver free end;

a biasing member positioned on the bearing case;

a plurality of bearings, each bearing positioned on the bearing case;

a spring sleeve engageable with the biasing member and circumscribing the bearing case, biasing member and bearings;

a face plate positioned adjacent to the bearing case and fixedly coupled thereto, the face plate engaging the spring sleeve such that the biasing member and bearings are enclosed within the spring sleeve and the face plate;

a barrel having a first end and a second end;

a barrel sleeve operably coupled to the barrel;

wherein in an engaged state, the barrel sleeve is positioned within the bearing case and the bearings are positioned between the barrel sleeve and bearing case such that the upper receiver and barrel are substantially aligned.

16. The modular firearm system of claim 15, wherein the bearing case includes a plurality of slots, each slot housing a corresponding bearing, each slot having a slot aperture extending through the bearing case such that each bearing engages the barrel sleeve when in the engaged state.

17. The modular firearm system of claim 15, wherein the spring sleeve comprises and upper member integrally formed with a lower member, the upper member having inner and outer diameters less than that of the lower member, the upper member having in inner surface comprising tapered upper and lower portions with a mid portion therebetween, the mid portion being substantially parallel with an outer surface of the upper member, the tapered lower portion engageable with the bearings.

18. The modular firearm system of claim 15, wherein the face plate comprises a lip extending along an outer edge thereof, the lip engageable with the spring sleeve to form a substantial seal.

19. The modular firearm system of claim 15, wherein the barrel sleeve is position on the barrel between the barrel first and second ends such that a barrel free end extends from the barrel sleeve.

20. The modular firearm system of claim 19, wherein the upper receiver and the barrel are directly engaged when in the engaged state.

* * * * *